US011071900B2

(12) United States Patent
Williams

(10) Patent No.: US 11,071,900 B2
(45) Date of Patent: Jul. 27, 2021

(54) SPORTS SIGNALING SYSTEM

(71) Applicant: Darwin David Williams, New Town, ND (US)

(72) Inventor: Darwin David Williams, New Town, ND (US)

( * ) Notice: Subject to any disclaimer, the term of this patent is extended or adjusted under 35 U.S.C. 154(b) by 0 days.

(21) Appl. No.: 16/602,860

(22) Filed: Dec. 11, 2019

(65) Prior Publication Data

US 2020/0188761 A1 Jun. 18, 2020

Related U.S. Application Data

(60) Provisional application No. 62/779,230, filed on Dec. 13, 2018.

(51) Int. Cl.

| | |
|---|---|
| ***G08B 1/08*** | (2006.01) |
| ***A63B 71/06*** | (2006.01) |
| ***A63B 71/12*** | (2006.01) |
| ***G08B 7/06*** | (2006.01) |
| ***G08C 17/00*** | (2006.01) |

(52) U.S. Cl.

CPC ..... *A63B 71/0622* (2013.01); *A63B 71/12* (2013.01); *G08B 7/06* (2013.01); *G08C 17/00* (2013.01); *A63B 2071/0655* (2013.01); *A63B 2071/0661* (2013.01); *A63B 2225/50* (2013.01)

(58) Field of Classification Search

CPC ..... A63B 71/0622; A63B 71/12; A63B 2071/0655; A63B 2071/0661; A63B 2225/50; G08B 7/06; G08C 17/00

USPC ..... 340/539.11

See application file for complete search history.

(56) References Cited

U.S. PATENT DOCUMENTS

| | | | | |
|---|---|---|---|---|
| 4,525,875 | A * | 7/1985 | Tomczak | A41D 13/0518 2/2.5 |
| 6,794,989 | B2 * | 9/2004 | Naegely | G08B 1/08 340/4.12 |
| 8,894,514 | B2 * | 11/2014 | Jennings | A63B 67/002 473/468 |
| 8,964,980 | B2 * | 2/2015 | Daniel | A63B 71/06 380/251 |
| 2003/0006903 | A1 * | 1/2003 | Naegely | G08B 1/08 340/4.12 |
| 2003/0163287 | A1 * | 8/2003 | Vock | A61B 5/1118 702/187 |

(Continued)

*Primary Examiner* — Zhen Y Wu

(74) *Attorney, Agent, or Firm* — Chen-Chi Lin

(57) ABSTRACT

A catcher's chest protector with electronic components. The device includes a padded chest protector including adjustable straps for securement to a baseball or softball catcher's torso. The chest protector includes a wireless receiver, an LED display, and a vibration mechanism. The LED display is disposed on a front side of the chest protector. The wireless receiver is configured to receive a remote signal corresponding to a particular instruction or strategy, whereby the instruction or strategy is displayed on the LED display for viewing by the pitcher and the other defensive position players. The wireless receiver is further configured to cause the vibration mechanism to vibrate in a predefined pattern upon receiving an instruction meant for the catcher, such that the catcher is secretly notified of the instruction. The chest protector can be utilized to speed up a game, or to accurately relay strategies and instructions to players.

19 Claims, 9 Drawing Sheets

(56) References Cited

U.S. PATENT DOCUMENTS

| | | | | |
|---|---|---|---|---|
| 2005/0170870 | A1* | 8/2005 | Goldenberg | A63B 69/00 455/575.2 |
| 2012/0079647 | A1* | 4/2012 | Doherty | A41D 13/015 2/463 |
| 2013/0063268 | A1* | 3/2013 | Golomb | G08B 21/0294 340/573.4 |
| 2015/0373450 | A1* | 12/2015 | Black | A42B 3/303 455/11.1 |
| 2015/0379351 | A1* | 12/2015 | Dibenedetto | H04N 5/44504 345/633 |
| 2017/0065872 | A1* | 3/2017 | Kelley | A63B 71/0622 |
| 2018/0311555 | A1* | 11/2018 | Danis | A63B 60/16 |
| 2018/0345117 | A1* | 12/2018 | Andon | G06F 3/016 |
| 2018/0365939 | A1* | 12/2018 | Inglot | G09B 19/0038 |
| 2019/0038932 | A1* | 2/2019 | Eckblad | G09B 19/0038 |
| 2019/0054347 | A1* | 2/2019 | Saigh | A61B 5/02055 |
| 2019/0060736 | A1* | 2/2019 | Harris | G08B 21/22 |
| 2019/0091545 | A1* | 3/2019 | Genova | H04W 4/80 |
| 2019/0362149 | A1* | 11/2019 | Mukhopadhyay | G06F 3/16 |
| 2020/0016474 | A1* | 1/2020 | Thompson | A41D 13/00 |
| 2020/0179742 | A1* | 6/2020 | Kulkarni | A41D 13/0518 |
| 2021/0001225 | A1* | 1/2021 | Panec | A63F 13/53 |

* cited by examiner

SPORTS SIGNALING SYSTEM

CROSS-REFERENCE TO RELATED APPLICATIONS

This application claims priority to and the benefit of the filing date of U.S. Provisional Application No. 62/779,230, filed Dec. 13, 2018, entitled "Chest Protector Plus," which is hereby incorporated by reference in its entirety.

BACKGROUND

The present disclosure relates generally to signal systems and, more particularly, to signaling systems for sports, such as for a baseball catcher receiving signals from a dugout and relying those signals to the defensive players.

Baseball and softball coaches often deliver hand signals to defensive players for a variety of situations that may arise during a baseball or softball game. Hand signals may be detected and stolen by the opposing team, leaving the team at a significant disadvantage with their strategy and tactics. Some hand signals may be difficult to discern or see for players in the outfield, such that players are unable to effectively communicate with their coach or teammates. Accordingly, a device that is configured to enable effective and private communication between coaches and players without such communication being compromised or detected by the opposing team is desired.

SUMMARY

According to an embodiment, a sports signaling system includes a manager unit and a player unit. The manager unit includes an input device, a processor, and a wireless transmitter operatively configured together. The player unit includes a wireless receiver, a processor, and an output device operatively configured together. In a number of baseball or softball embodiments, the manager unit is located at an off-field or remote location such as at or near a dugout, and the player unit is located at an on-field or in-play location such as disposed on the catcher at or near the home plate of a ball field. In use, a manager enters a desired call from a plurality of possible calls (e.g., a pitch for a fastball) via the input device of the manager unit from the off-field location. The processor then causes the transmitter to transmit a signal indicative of the desired call. The receiver then receives the transmitted signal from the manager unit and at an on-field location, with the processor of the player unit then causing the output device to output a signal indicative of the desired call from the manager. The output signal may be a visual signal visible to one of more defensive players (e.g., the pitcher). The output signal may also include a vibratory signal perceived by the catcher.

The features and functions discussed herein can be achieved independently in various embodiments or may be combined in yet other embodiments, further details of which can be seen with reference to the following description and drawings.

DETAILED DESCRIPTION

Figure 1:
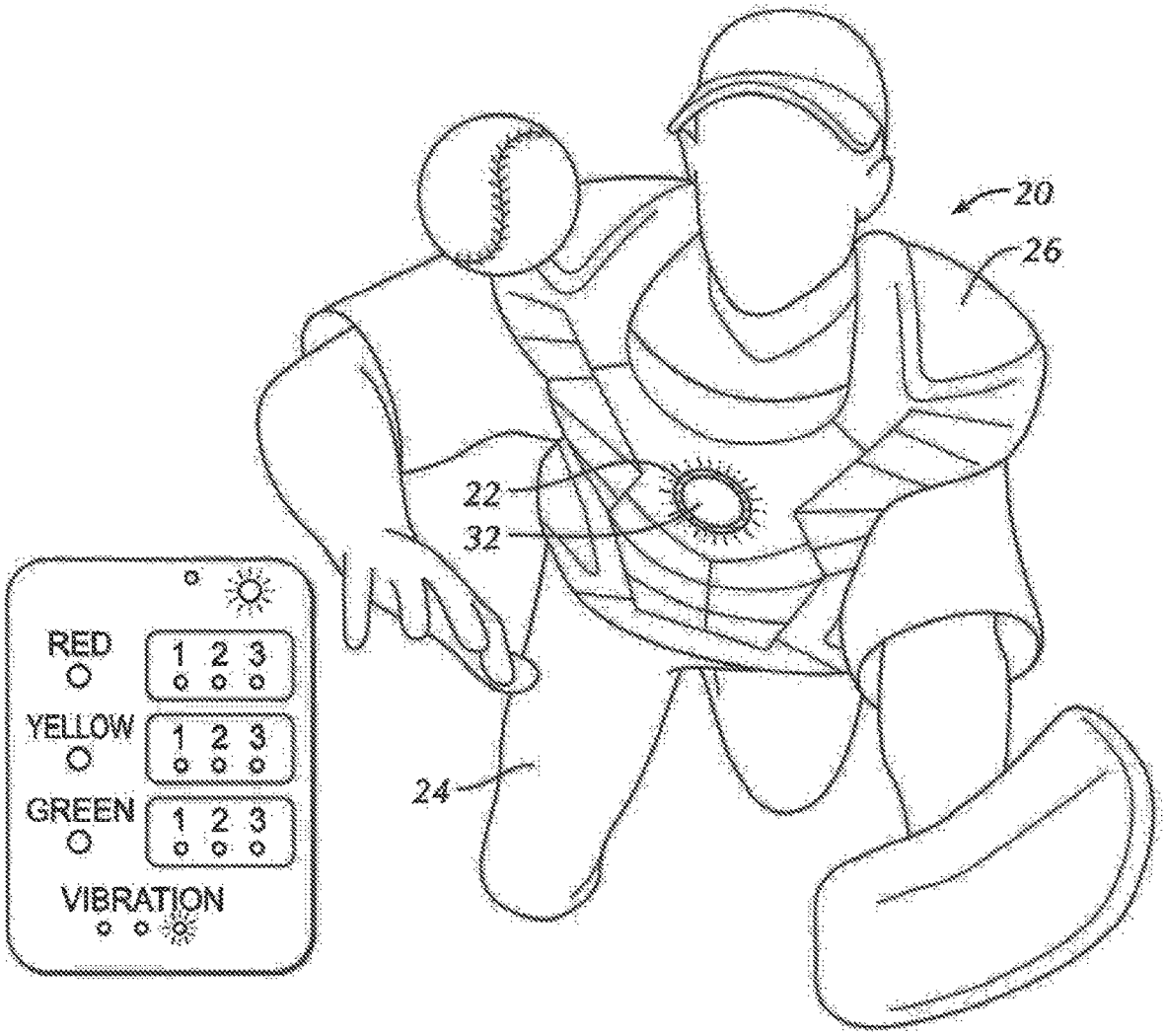
FIG. 1 shows a perspective view of an embodiment of the catcher's chest protector with electronic components while disposed on a user and in use.
Figure 2:
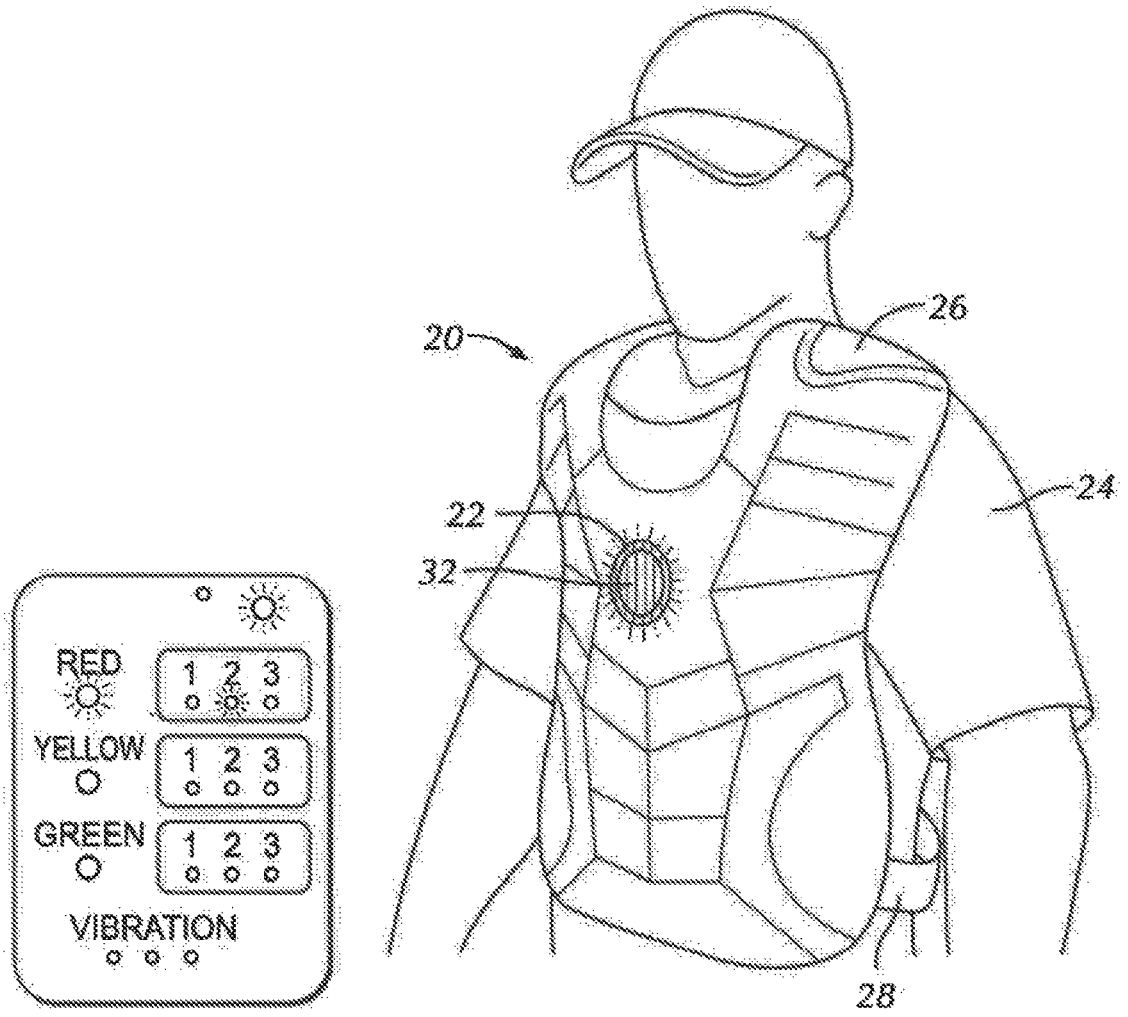
FIG. 2 shows a perspective view of an embodiment of the catcher's chest protector with electronic components while disposed on a user.

The following detailed description of certain embodiments will be better understood when read in conjunction with the appended drawings. It should be understood that the various embodiments are not limited to the arrangements and instrumentality shown in the drawings.

As used herein, the terms "module", "system," or "unit," may include a hardware and/or software system that operates to perform one or more functions. For example, a module, unit, or system may include a computer processor, controller, or other logic-based device that performs operations based on instructions stored on a tangible and non-transitory computer readable storage medium, such as a computer memory. Alternatively, a module, unit, or system may include a hard-wired device that performs operations based on hard-wired logic of the device. The modules, units, or systems shown in the attached figures may represent the hardware that operates based on software or hardwired instructions, the software that directs hardware to perform the operations, or a combination thereof.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Overview

Referring to FIGS. 1 to 5, there are shown perspective views of an embodiment of the catcher's chest protector 20 with electronic components 22 while disposed on a user 24. The device 20 includes a padded chest protector 26 including adjustable straps 28 for securement to a baseball or softball catcher's 24 torso. In the illustrated embodiment, the padded chest protector 26 comprises a tapering configuration, wherein an upper end thereof is configured to extend across the shoulders of a user 24 and tapers downwardly toward a lower end of the padded chest protector 26, wherein the lower end is configured to extend across the waist of the user 24. The padded chest protector 20 includes a wireless receiver 30, an LED display 32, and a vibration mechanism. The LED display 32 is disposed on a front side of the chest protector 26.

Figure 3:
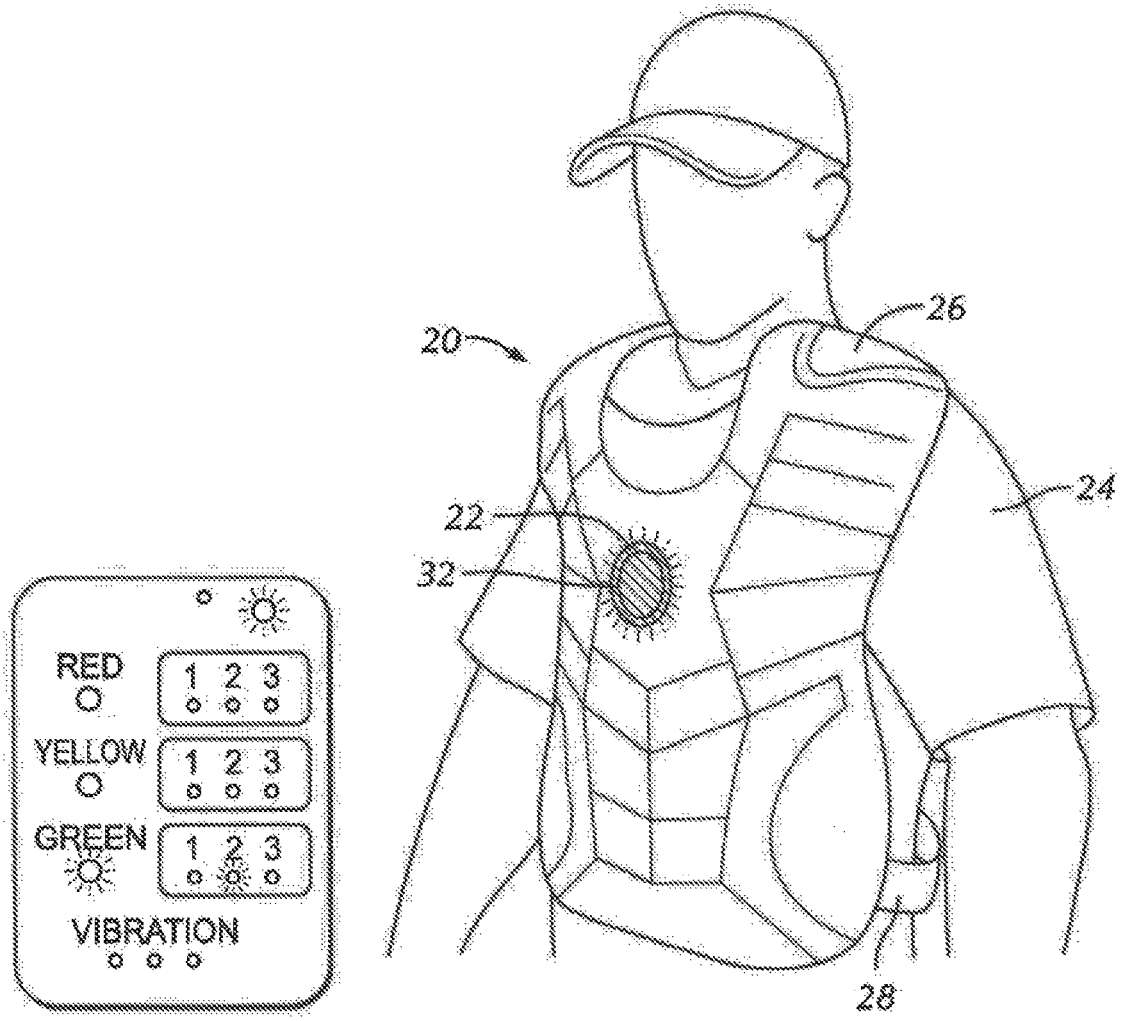
FIG. 3 shows an additional perspective view of an embodiment of the catcher's chest protector with electronic components while disposed on a user.

In the illustrated embodiment, the LED display 32 is disposed near the upper end of the padded chest protector 26, wherein the LED display 32 is configured to selectively illuminate with a red hue (shown in FIG. 2), a yellow hue, or a green hue (shown in FIG. 3). Further, the LED display 32 is configured to illuminate in a predefined pattern. In the shown embodiment, the predefined pattern comprises three different settings. In this manner, individuals may formulate specific instructions or strategies using a specific setting and hue.

Figure 4:
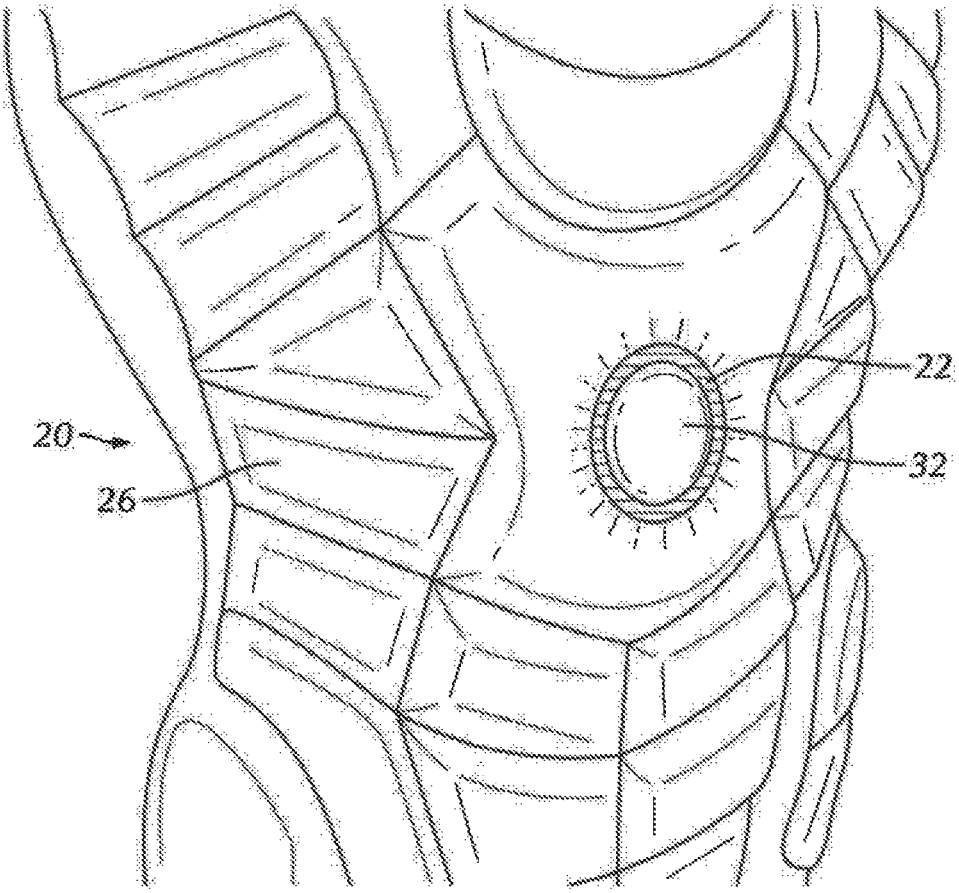
FIG. 4 shows a close-up view of an embodiment of the catcher's chest protector with electronic components.
Figure 5:
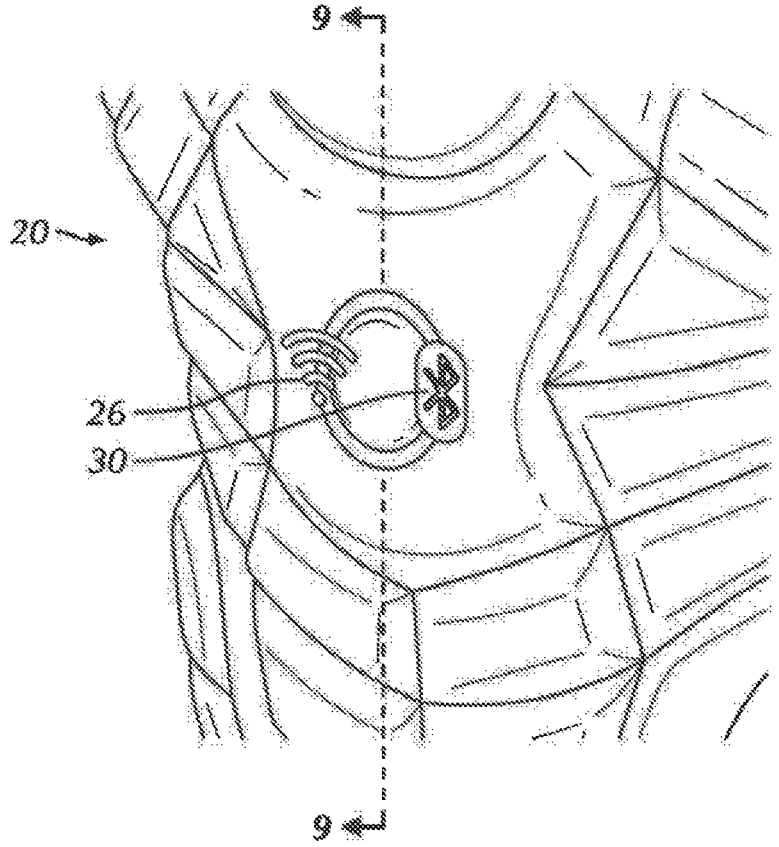
FIG. 5 shows an additional close-up view of an embodiment of the catcher's chest protector with electronic components.

Referring to FIGS. 4 and 5, there are shown close-up views of an embodiment of the catcher's chest protector 20 with electronic components 22. The wireless receiver 30 is configured to receive a remote signal corresponding to a particular instruction or strategy, whereby the instruction or strategy is displayed on the LED display 32 for viewing by the pitcher and the other defensive position players.

Referring to FIG. 1, there is shown a perspective view of an embodiment of the catcher's chest protector 20 with electronic components 22 while disposed on a user 24 and in use. The wireless receiver 30 is further configured to cause the vibration mechanism to vibrate in the predefined pattern upon receiving an instruction meant for the catcher, such that the catcher is secretly notified of the instruction. The chest protector 20 can be utilized to speed up a game and to accurately relay strategies and instructions to players.

Detailed Embodiments

Various embodiments described and/or illustrated herein provide systems for enabling signals to be transmitted from an off-field location to an on-field location, for example, from a dugout to a baseball catcher during a baseball game. Various methods for utilizing such a system are also described and/or illustrated.

Figure 6:
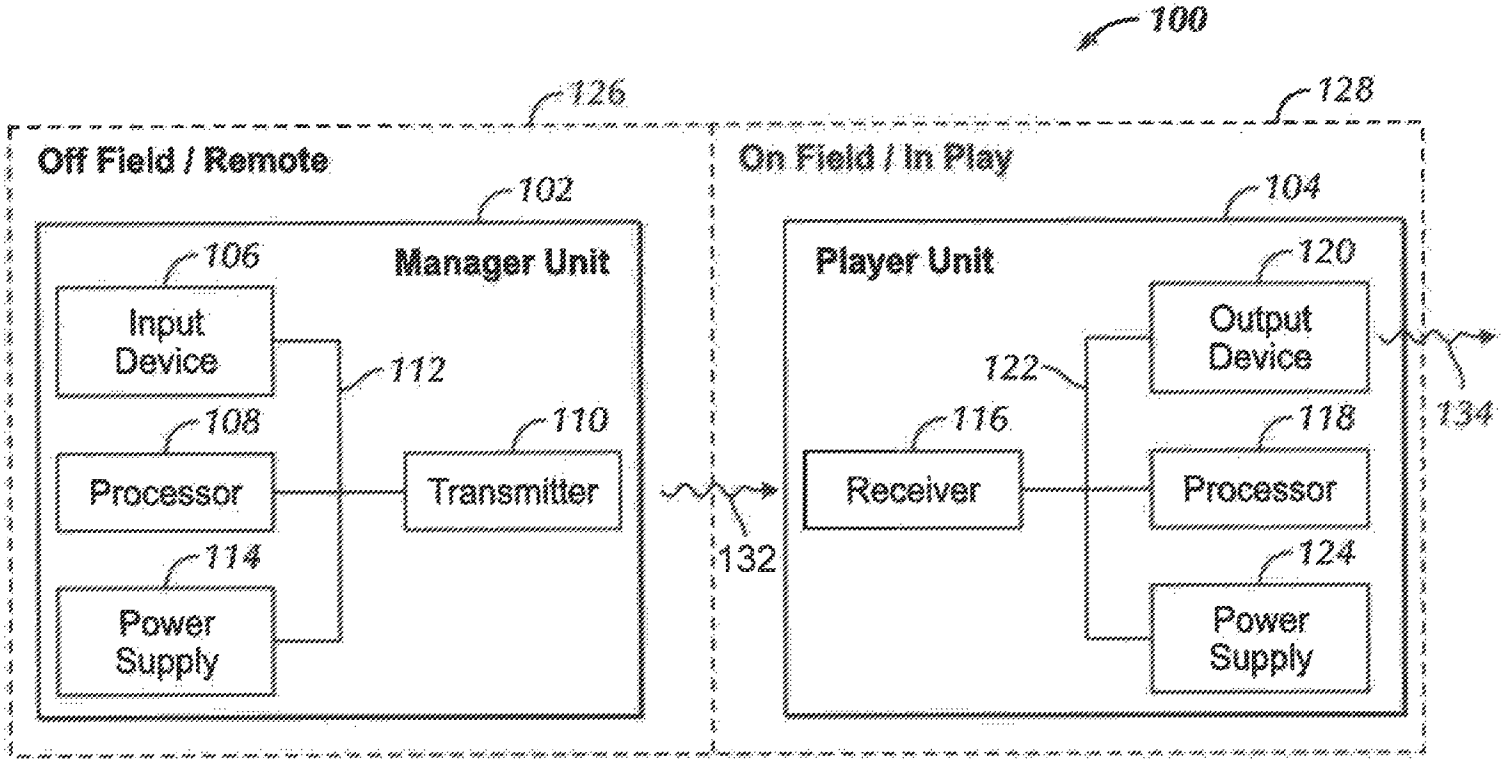
FIG. 6 is a functional block diagram of a sports signaling system including an off-field unit and an on-field unit.

Referring to FIG. 6, a sports signaling system 100 according to a number of embodiments includes a manager unit 102 and a player unit 104. The manager unit 102 includes an input device 106, a processor 108, and a wireless transmitter 110 operatively configured together, e.g., by circuitry or a bus 112. The manager unit 102 may also include a power supply 114. The player unit 104 includes a wireless receiver 116, a processor 118, and an output device 120 operatively configured together, e.g., by circuitry or a bus 122. The player unit 104 may also include a power supply 124.

Figure 7:
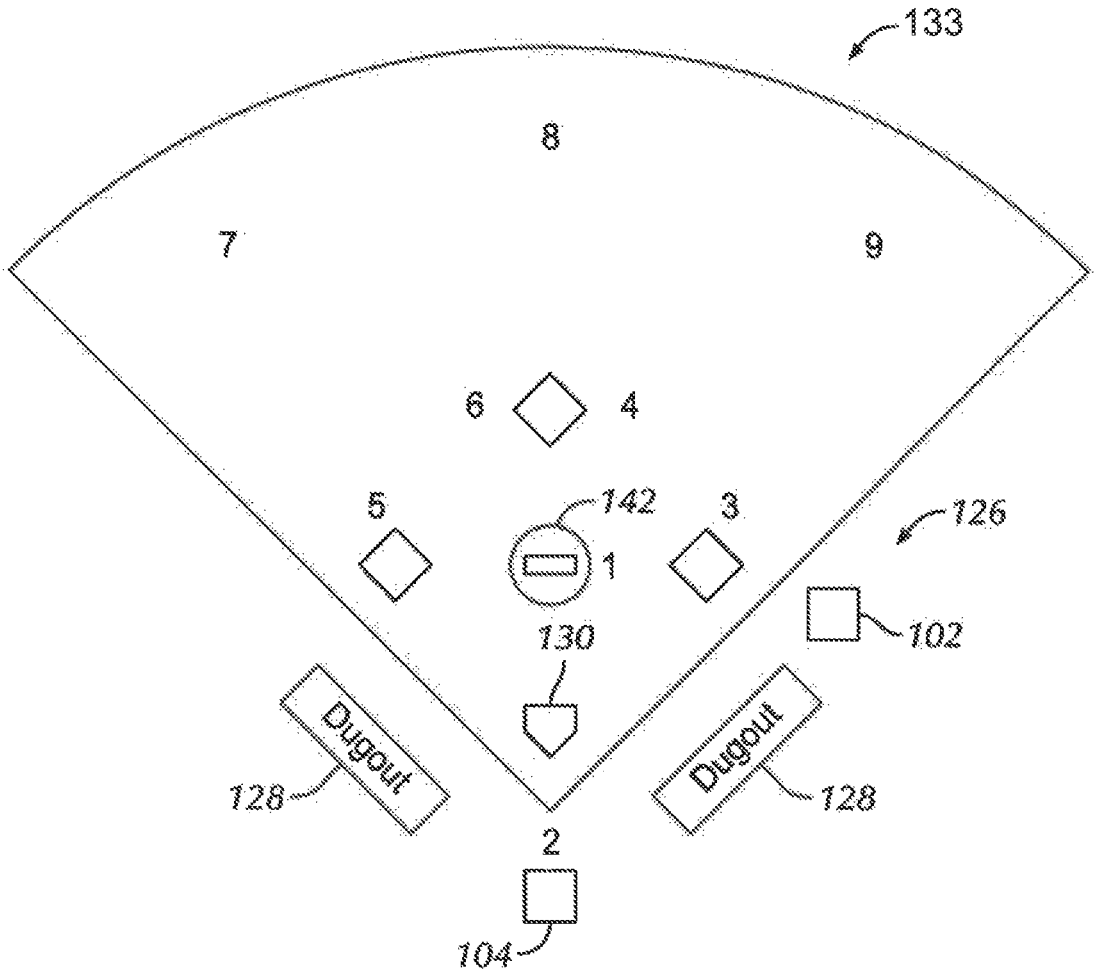
FIG. 7 is a schematic illustration of a baseball or softball field, particularly showing the Position number of the players.

According to a number of baseball or softball embodiments as shown in FIG. 7, the manager unit 102 is located at an off-field or remote location 126 such as at or near a dugout 128, and the player unit 104 is located at an on-field or in-play location such as disposed on the catcher (indicated by Player Position 2) at or near the home plate 130 of a ball field 133.

In a method of use for the ball game embodiment shown in FIG. 7, a manager enters a desired call from a plurality of possible calls (e.g., a pitch for a fastball) via the input device 106 of the manager unit 102 from the off-field location 126. The processor 108 then causes the transmitter 110 to transmit a signal 132 indicative of the desired call. The receiver 116 then receives the transmitted signal 132 from the manager unit 102 and at an on-field location 128, with the processor 118 of the player unit 104 then causing the output device 120 to output a signal 134 indicative of the desired call from the manager. In other words, the input device 106 of the manager unit 102 enables a desired call to be selected from a plurality of possible calls, e.g., a plurality of pitches, with the processor 108 thereafter causing the transmitter 110 to transmit the signal 132 indicative of the desired call.

Figure 8:
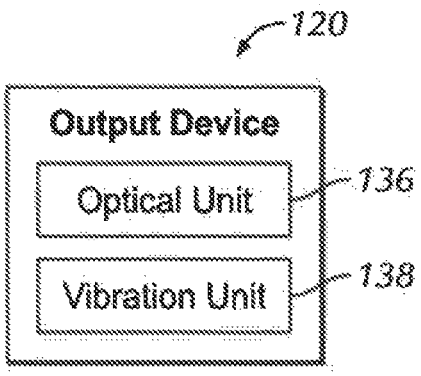
FIG. 8 is a functional block diagram of an output device of a player unit according to some of the embodiments.

In a number of embodiments as shown in FIG. 8, the output device 120 of the player unit 104 includes an optical output 136 configured to provide a visual signal 134 indicative of the desired call from the manager. In still other embodiments, the output device 120 of the player unit 104 also includes a vibration output 138 configured to provide a vibratory signal 134 indicative of the desired call from the manager.

Figure 9:
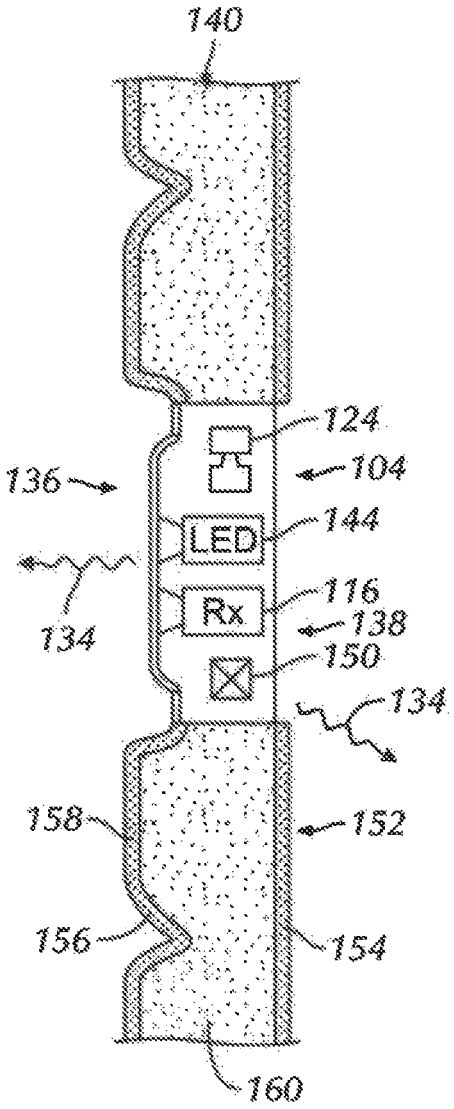
FIG. 9 is a cross-sectional view of a chest protector for a catcher taken along line 9-9 of FIG. 5.

As shown in the embodiments represented in FIG. 9, the player unit 104 may be disposed on a piece of sports equipment such as a chest protector 140 a catcher (e.g., the chest protector 20 of FIGS. 1 to 5). In other embodiments (not shown), the player unit 104 may be disposed on any of the catcher's equipment, such as mask, shin guards, helmet, mitt, and so on. As shown in the baseball/softball embodiment, the player unit 104 may be integrally disposed on or within the chest protector 140 such that the signal output 134 by the output device 120 is visible to at least the pitcher (see Position 1 in FIG. 7) located at or near the pitcher's mound 142 of a ball field 133. In many embodiments, the visual output signal 134 may be visible to any number of the ball players (indicated by Positions 2, 3, 4, 5, 6, 7, 8, and 9 in FIG. 7) in the field of play 133.

With continued reference to FIG. 9, the optical unit 136 may be configured to illuminate in a plurality of colors, for example, red, green, yellow, and blue, each corresponding to one of a plurality of desired calls, or each being utilized in a particular pattern to represent a desired call. More specifically, the processor 118 of the player unit 104 may be configured to cause the optical unit 136 to illuminate in a plurality of predefined patterns of colors each corresponding to one of a plurality of desired calls. In such embodiments, the optical unit 136 may include a plurality of differently colored LEDs or one of more multi-color LEDs. Alternatively, the processor 108 of the manager unit 102 may be configured to cause the transmitter 110 to transmit a plurality of the signals 132 to the player unit 104 indicative of the desired call.

Figure 10:
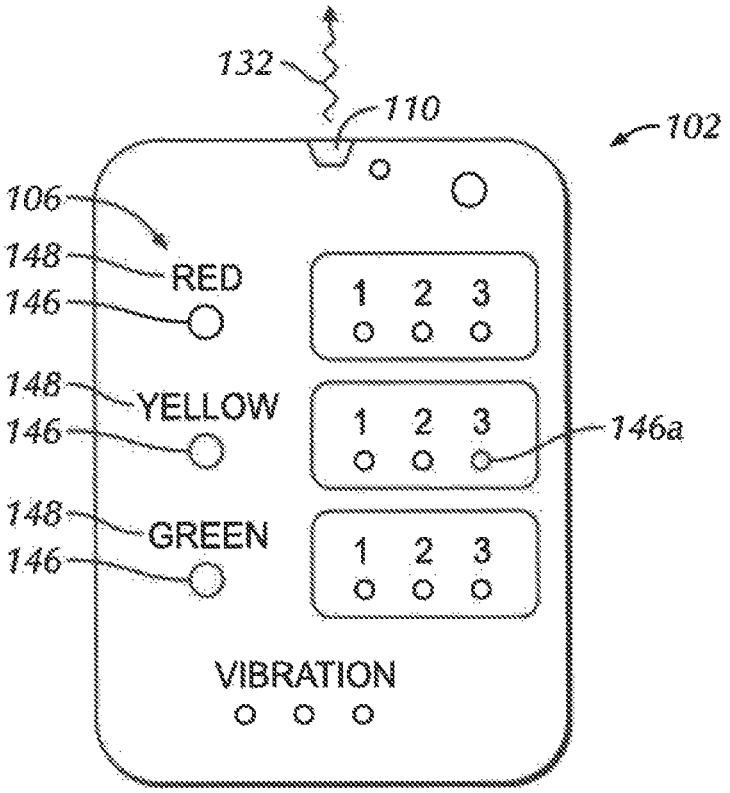
FIG. 10 illustrates embodiments of a hand-held manager unit of the signaling system.

With additional reference to the embodiments shown in FIG. 10, the input device 106 of the manager unit 102 may include a plurality of buttons 146 configured such that when respectively actuated, the processor 108 of the manager unit 102 causes the transmitter 110 to transmit a signal 132 indicative of the actuated button 146. The manager unit 102 may also include indicia 148 corresponding to each of the buttons 146, for example, RED, YELLOW, GREEN, VIBRATE, 1, 2, and 3 as shown. Accordingly in use, the manager may actuate the button corresponding to YELLOW 3 (indicated by reference number 146*a*), which would then cause the signal 132 of YELLOW 3 to be transmitted by the transmitter 110. In other embodiments, the manager may actuate any number of the buttons 146 to transmit signals 132 corresponding to any number of desired calls selected from a plurality of desired calls, e.g., pitches, locations, defensive plays, and so on. In still other embodiments, the plurality of buttons 146 may further includes buttons corresponding to a plurality of patterns of colors.

Referencing again FIG. 9, in the embodiments in which the output device 120 of the player unit 104 is configured to generate a vibratory signal 134, the vibration unit 138 may include any known vibratory device 150 such as a piezoelectric device. The vibration unit 150 may be disposed on an inner side 152 of the chest protector 140 such that when the chest protector 140 is being worn by a catcher, the vibration unit 150 is position at or near the body of the catcher such that the catcher is able to determine the desired call. Accordingly, as an alternative to or in addition to the optical signal 134 transmitted by the optical unit 136, the manager unit 102 may include a plurality of buttons 146 configured such that when respectively actuated, the processor 108 of the manager unit causes the transmitter 110 to transmit a signal 132 indicative of the actuated button to cause the vibration unit 138 to vibrate.

As shown in FIG. 9, the chest protector 140 may include an inner layer 154 disposed on the inner side 152 and an outer layer 156 disposed on an outsider side 158 with a layer of protective padding 160 disposed therebetween. In addition to being integrally disposed in the chest protector 140, the player unit 104 may be attached to the outer surface 158 of the outer layer, for example, releasably attached with hook-and-eye fasteners (not shown). As shown in FIG. 10, the manager unit 102 may be configured as a hand-held device with electro-mechanical input devices, touch-screen input devices, and so on. In addition, the manager unit 102 may be configured as an application for a smartphone. Further, the transmitter 110 may be configured as any known wireless transmitter, such as a Wi-Fi transmitter, a Bluetooth transmitter, a near-field communication transmitter, or a cellular device, with the receiver 116 of the player unit 104 being complementarily configured.

Different examples and aspects of the apparatus and methods are disclosed herein that include a variety of components, features, and functionality. It should be understood that the various examples and aspects of the apparatus and methods disclosed herein may include any of the components, features, and functionality of any of the other examples and aspects of the apparatus and methods disclosed herein in any combination, and all of such possibilities are intended to be within the spirit and scope of the present disclosure.

Many modifications and other examples of the disclosure set forth herein will come to mind to one skilled in the art to which the disclosure pertains having the benefit of the teachings presented in the foregoing descriptions and the associated drawings.

It should be noted that the particular arrangement of components (e.g., the number, types, placement, or the like) of the illustrated embodiments may be modified in various alternate embodiments In various embodiments, different numbers of a given module or unit may be employed, a different type or types of a given module or unit may be employed, a number of modules, systems, or units (or aspects thereof) may be combined, a given module or unit may be divided into plural modules (or sub-modules), systems (or subsystems), or units (or sub-units), a given module, system, or unit may be added, or a given module, system, or unit may be omitted.

It should be noted that the various embodiments may be implemented in hardware, software or a combination thereof. The various embodiments and/or components, for example, the modules, or components and controllers therein, also may be implemented as part of one or more computers or processors. The computer or processor may include a computing device, an input device, a display unit and an interface, for example, for accessing the Internet. The computer or processor may include a microprocessor. The microprocessor may be connected to a communication bus. The computer or processor may also include a memory. The memory may include Random Access Memory (RAM) and Read Only Memory (ROM). The computer or processor further may include a storage device, which may be a hard-disk drive or a removable storage drive such as a solid state drive, flash drive, and the like. The storage device may also be other similar means for loading computer programs or other instructions into the computer or processor.

As used herein, the term "system," "computer," "controller," and "module" may each include any processor-based or microprocessor-based system including systems using microcontrollers, reduced instruction set computers (RISC), application specific integrated circuits (ASICs), logic circuits, GPUs, FPGAs, and any other circuit or processor capable of executing the functions described herein. The above examples are exemplary only, and are thus not intended to limit in any way the definition and/or meaning of the term "module" or "computer."

The computer, module, or processor executes a set of instructions that are stored in one or more storage elements, in order to process input data. The storage elements may also store data or other information as desired or needed. The storage element may be in the form of an information source or a physical memory element within a processing machine.

The set of instructions may include various commands that instruct the computer, module, or processor as a processing machine to perform specific operations such as the methods and processes of the various embodiments described and/or illustrated herein. The set of instructions may be in the form of a software program. The software may be in various forms such as system software or application software and which may be embodied as a tangible and non-transitory computer readable medium. Further, the software may be in the form of a collection of separate programs or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program. The individual components of the various embodiments may be virtualized and hosted by a cloud type computational environment, for example, to allow for dynamic allocation of computational power, without requiring the user concerning the location, configuration, and/or specific hardware of the computer system.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from their scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, paragraph (f), unless and until such claim limitations expressly use the phrase "means for" followed by a statement of function void of further structure.

This written description uses examples to disclose the various embodiments, and also to enable a person having ordinary skill in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

What is claimed is:

1. A sports signaling system comprising:

a manager unit including an input device, a processor, and a wireless transmitter operatively configured, the input device enabling a desired call to be selected from a plurality of possible calls, and the processor of the manager unit causing the wireless transmitter to transmit a signal indicative of the desired call; and a player unit including a wireless receiver, a processor, and an output device operatively configured, the wireless receiver receiving the transmitted signal from the manager unit, the processor of the player unit causing the output device to output at least one output signal indicative of the desired call;

wherein the player unit is attached to an equipment configured to be worn by a player; and wherein the at least one output signal includes a vibratory signal indicative of the desired call.

2. The system of claim 1, wherein the at least one output signal includes a visual signal indicative of the desired call.

3. The system of claim 1, wherein the player is a catcher; and wherein the equipment is a chest protector of the catcher.

4. The system of claim 1 further comprising a chest protector for a catcher, wherein the player unit is disposed on the chest protector.

5. The system of claim 4 wherein the player unit is integrally disposed on the chest protector such that the at least one output signal output by the output device is visible to at least a pitcher located at a pitcher's mound.

6. The system of claim 5 wherein the output device includes an optical unit configured to display the at least one output signal visible at least to the pitcher located at the pitcher's mound.

7. The system of claim 6 wherein the optical unit is configured to illuminate in a plurality of colors each corresponding to one of the plurality possible calls.

8. The system of claim 7 wherein the processor of the player unit is configured to cause the optical unit to illuminate in a plurality of predefined patterns of colors each corresponding to one of the plurality of possible calls.

9. The system of claim 8 wherein the optical unit includes a plurality of differently colored LEDs.

10. The system of claim 8 wherein the optical unit includes a multi-color LED.

11. The system of claim 8 wherein the processor of the manager unit is configured to cause the wireless transmitter to transmit a plurality of signals to the player unit indicative of the desired call.

12. The system of claim 11 wherein the input device of the manager unit includes a plurality of buttons configured such that when respectively actuated, the processor of the manager unit causes the wireless transmitter to transmit a given signal indicative of the actuated button.

13. The system of claim 12 wherein the plurality of buttons includes buttons corresponding to a plurality of colors.

14. The system of claim 13 wherein the plurality of buttons further include buttons corresponding to a plurality of patterns of colors.

15. The system of claim 6 wherein the output device further includes a vibration unit configured to vibrate such that the catcher is able to determine the desired call.

16. The system of claim 15 wherein the input device of the manager unit includes a plurality of buttons configured such that when respectively actuated, the processor of the manager unit causes the wireless transmitter to transmit a respective signal indicative of the respectively actuated button to cause the vibration unit to vibrate.

17. The system of claim 1 wherein the manager unit is a hand-held device.

18. A method of providing signals in a baseball game or a softball game from an off-field location to the player at an on-field location, the method comprising the steps of utilizing the system of claim 1, wherein the player is a catcher; wherein the at least one output signal includes a visual signal and the vibratory signal; and wherein the manager unit is located at the off-field location and the player unit is disposed on the equipment worn by the catcher; and a pitcher seeing the visual signal from the output device and the catcher sensing the vibratory signal from the output device.

19. The sports signaling system of claim 1, wherein the player is a catcher of a baseball game or a softball game;

wherein the equipment is a chest protector of the catcher;

wherein the chest protector is of a tapering configuration; and wherein the output device comprises a piezoelectric device to vibrate.

* * * * *